US006827396B1

(12) United States Patent
Jewell

(10) Patent No.: US 6,827,396 B1
(45) Date of Patent: Dec. 7, 2004

(54) REMORA POWERBOAT CHAIR

(76) Inventor: Charles C. Jewell, 26 Dogwood La., Freehold, NJ (US) 07728

( * ) Notice: Subject to any disclaimer, the term of this patent is extended or adjusted under 35 U.S.C. 154(b) by 0 days.

(21) Appl. No.: 10/810,543

(22) Filed: Mar. 29, 2004

(51) Int. Cl.[7] ..... A47C 4/00
(52) U.S. Cl. ..... 297/16.1; 297/463.2
(58) Field of Search ..... 248/501, 500, 248/505, 188, 188.9; 297/463.1, 463.2, 270.1, 270.5, 16.1, 76, 40, 188.14

(56) References Cited

U.S. PATENT DOCUMENTS 53,415 A * 3/1866 Cole ..... 248/501
5,513,900 A * 5/1996 Iglesias ..... 297/463.1
6,095,607 A * 8/2000 Wenzel ..... 297/344.18
6,149,238 A * 11/2000 Tsai ..... 297/411.43

* cited by examiner

*Primary Examiner*—Milton Nelson, Jr.
(74) *Attorney, Agent, or Firm*—Charles I. Brodsky

(57) ABSTRACT

A collapsible casual chair including first and second stabilizer bars individually positioned forwardly of the front and rear legs of the chair in supplementing its support, and a substantially U-shaped bar extending rearwardly from the front legs around the second stabilizer bar and the rear legs, with a manually operated suction hand cup enclosing the U-shaped bar, operable to releasably secure the chair to a flat surface at the front of a powerboat by vacuum action.

15 Claims, 6 Drawing Sheets

REMORA POWERBOAT CHAIR

CROSS-REFERENCE TO RELATED APPLICATIONS

NONE

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

NOT APPLICABLE

BACKGROUND OF THE INVENTION

1. Field of the Invention

This invention relates to the marine powerboat industry, in general, and to sport fishermen, cruisers and sport powerboats, in particular.

2. Description of the Related Art

As is well known and understood, pleasure and sports craft of this type are designed with a back well with integral seating, and of a size to typically accept the added placement of casual chairs to accommodate the various passengers aboard. Because the back of the boat moves much less under the action of waves than does the front, the singular placement of such additional seating presents little discomfiture to the occupant and exhibits only a tolerable sway as the boat moves forward, and from side-to-side.

Many occasions arise, however, where a passenger in the back well ventures (or would like to venture) to the front of the boat. There, because the front does not support the weight of the engine, the boat moves substantially more from side-to-side, and up-and-down due to wave action—oftentimes, sufficient to cause the person to lose his/her balance, or even to fall. Chairs, usually being long-legged, are top heavy so sitting on them in front does not stabilize the situation; and, if employed, frequently leads to both the chair and its occupant being flung about. Still, many occasions arise where being at the front of the boat is desirable, especially without there being any need for having to hold on for dear life.

Motor and luxury yachts have, of recent times, tended to deal with this problem by molding the fiberglass hulls to integrally receive specially configured lounge chairs for one to just sit upon, or to lay on while soaking in the sun. Located so as not to be weight bearing on the glass windows for the cabin below, these built-in manufactures will be understood as not really being an available solution for smaller boats or for non-luxury boats where the designers have opted to build a chair into the fiberglass hull.

As will become clear from the following description, the present invention describes a powerboat chair for use on these small and non-luxury crafts which can be collapsed and folded for storage when not being used, and which can be opened for placement in an exceedingly secure manner at the front of the vessel. Appreciating that the fish that secure themselves to the body of a shark swimming through the waters are known as "Remora", the chair of the present invention will henceforth be referred to as a "Remora powerboat chair".

SUMMARY OF THE INVENTION

As will become clear from the following description, the "Remora powerboat chair" includes a collapsible chair having pairs of front and rear legs respectively supporting a seat to be sat upon when opened. A first stabilizer bar is positioned forwardly of the front legs and under the seat for support when the chair is opened, with the first stabilizer bar being secured inwardly of the front legs; and with the opposite ends of the first stabilizer bar resting on the same level surface as does the pair of front legs. A second stabilizer bar is additionally positioned forwardly of the rear legs and under the seat for support when the chair is opened—with the second stabilizer bar being secured inwardly of the rear legs, and with its opposite ends likewise resting on the same level surface as does the pair of rear legs. As will be seen, a substantially U-shaped bar extends rearwardly from a first location on one of the front legs, running outwardly along one end of the second stabilizer bar, both of the rear legs, and the other end of the second stabilizer bar to a second location on the other front leg. A manually operated suction cup couples with the substantially U-shaped bar for then releasably securing the collapsible chair to a flat surface by vacuum action. With the front and rear legs being of a tubular aluminum construction and with the seat being of a fabric composition, the powerboat chair of the invention will thus be seen as one where this typical casual chair construction is supplemented by forwardly positioned stabilizer bars for support, and with the front legs being joined together by a rearwardly extending U-shaped bar secured with a suction hand cup, all essentially fastening the chair to the deck by releasable vacuum action.

With the clearance of the substantially U-shaped bar from the ends of the second stabilizer bar and from the rear chair legs, the substantially U-shaped bar, in a preferred embodiment of the invention, can thus be angled or rotated upwardly—to allow for vacuum securement by the suction cup at any location at the front of the powerboat, even to the windshield of a small cruiser or sport fisher. In such embodiment, the manually operated suction hand cup includes a pair of oppositely positioned round suction cups—although in other constructions, one, three, or four suction cups could be utilized instead depending upon the degree of vacuum securement desired. Because powerboats, regardless of their size are fabricated of white fiberglass, with the present invention, the suction cups employed in the vacuum action are preferably selected of white rubber construction so as not to mar any surface. In similar manner, the bottoms of the chair legs and stabilizer bars are cushioned as well, preferably of a white rubber construction also. Manually operated suction hand cups of these manners are commercially available, where operation involves either lever squeezing or flipping, or pump action, to securely clamp their rubber pads to the surface by vacuum. Whether the chair is to be secured to the front of the boat or to the driver's windshield (or even in the back well), a high degree of steadiness results, allowing the occupant of the chair to sit securely, even as the boat bounces about under action of the oncoming waves.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 1:
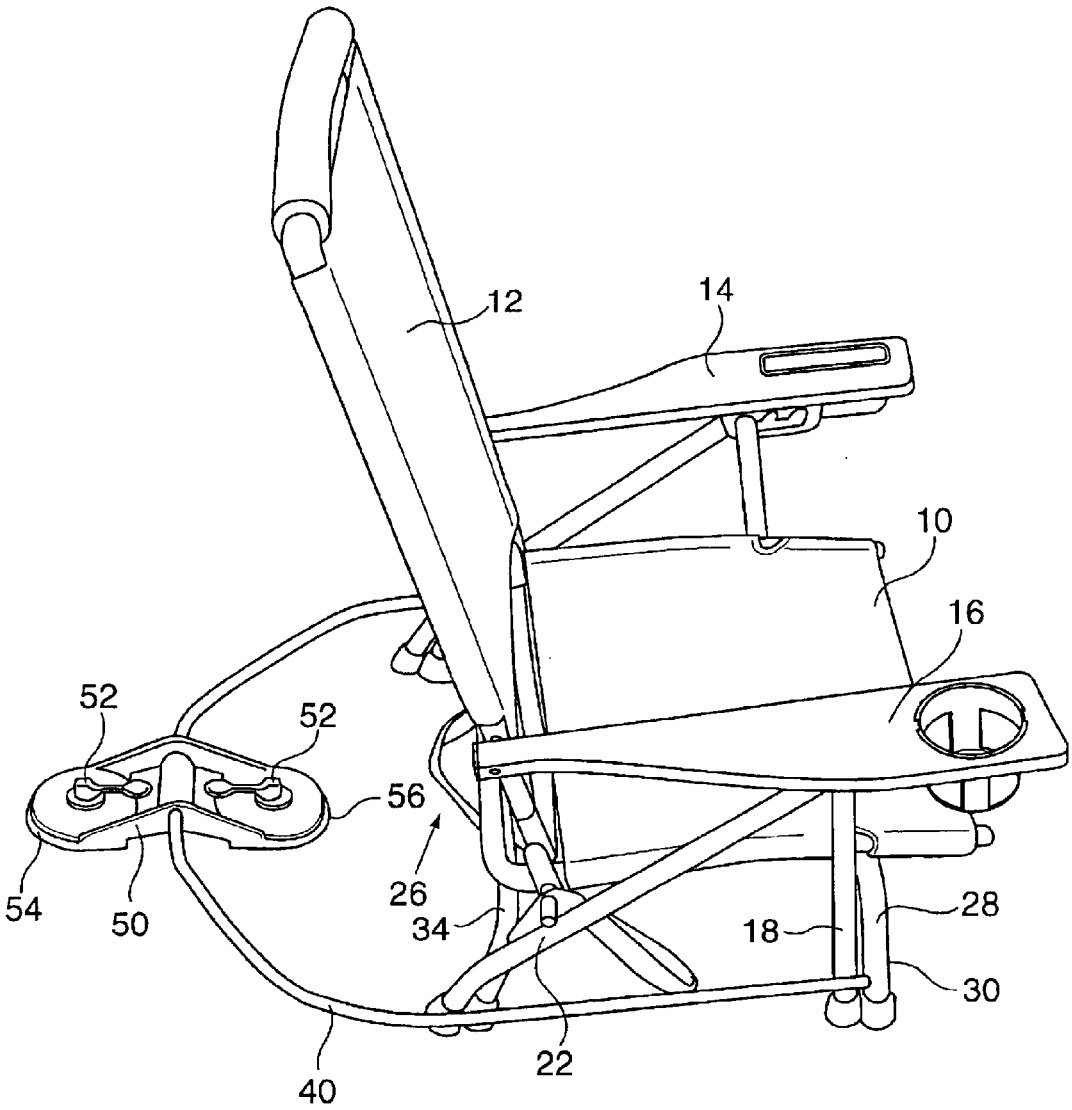
FIGS. 1–5 are helpful in a visualization and understanding of the Remora powerboat chair of the invention.
Figure 2:
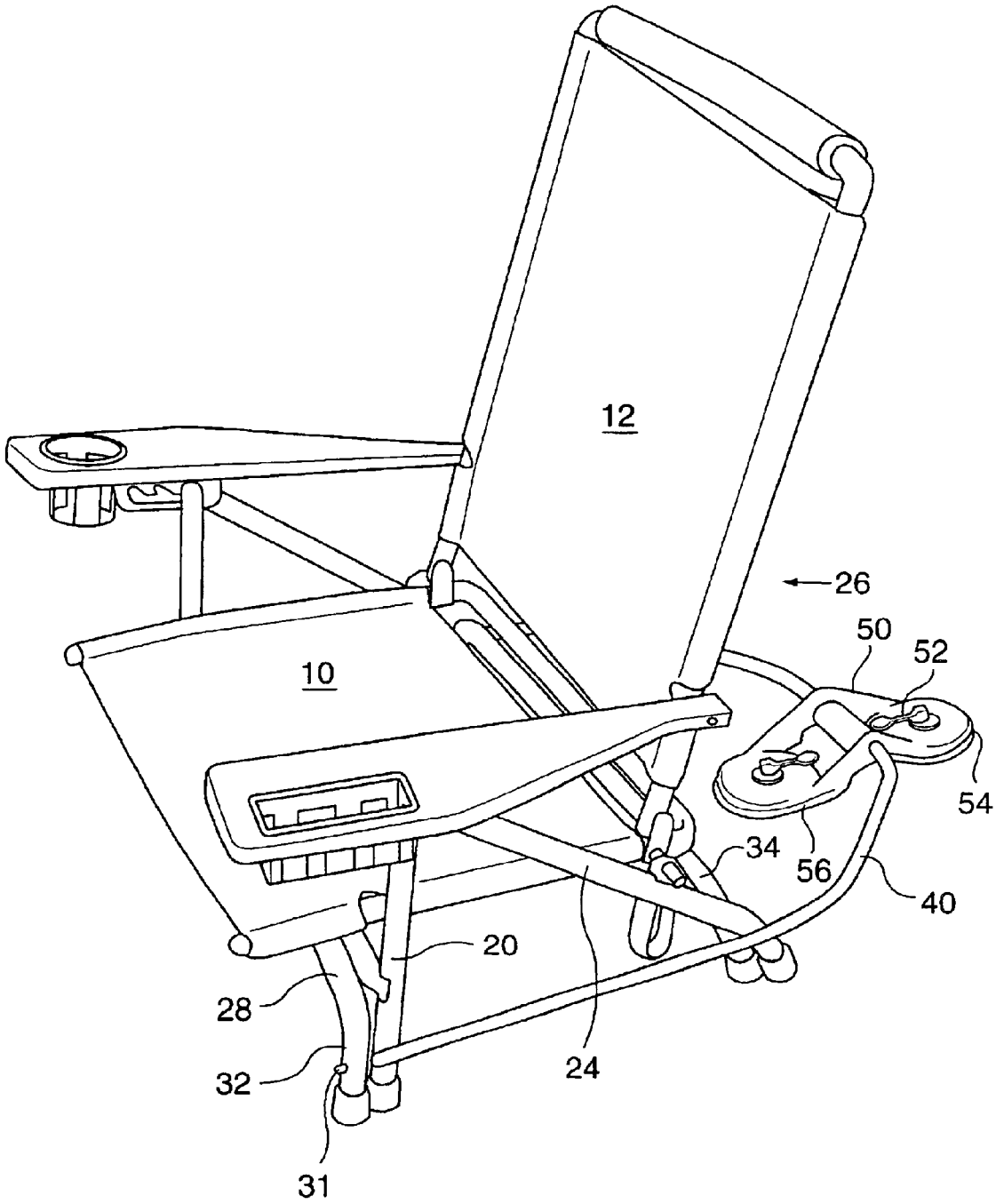
Figure 3:
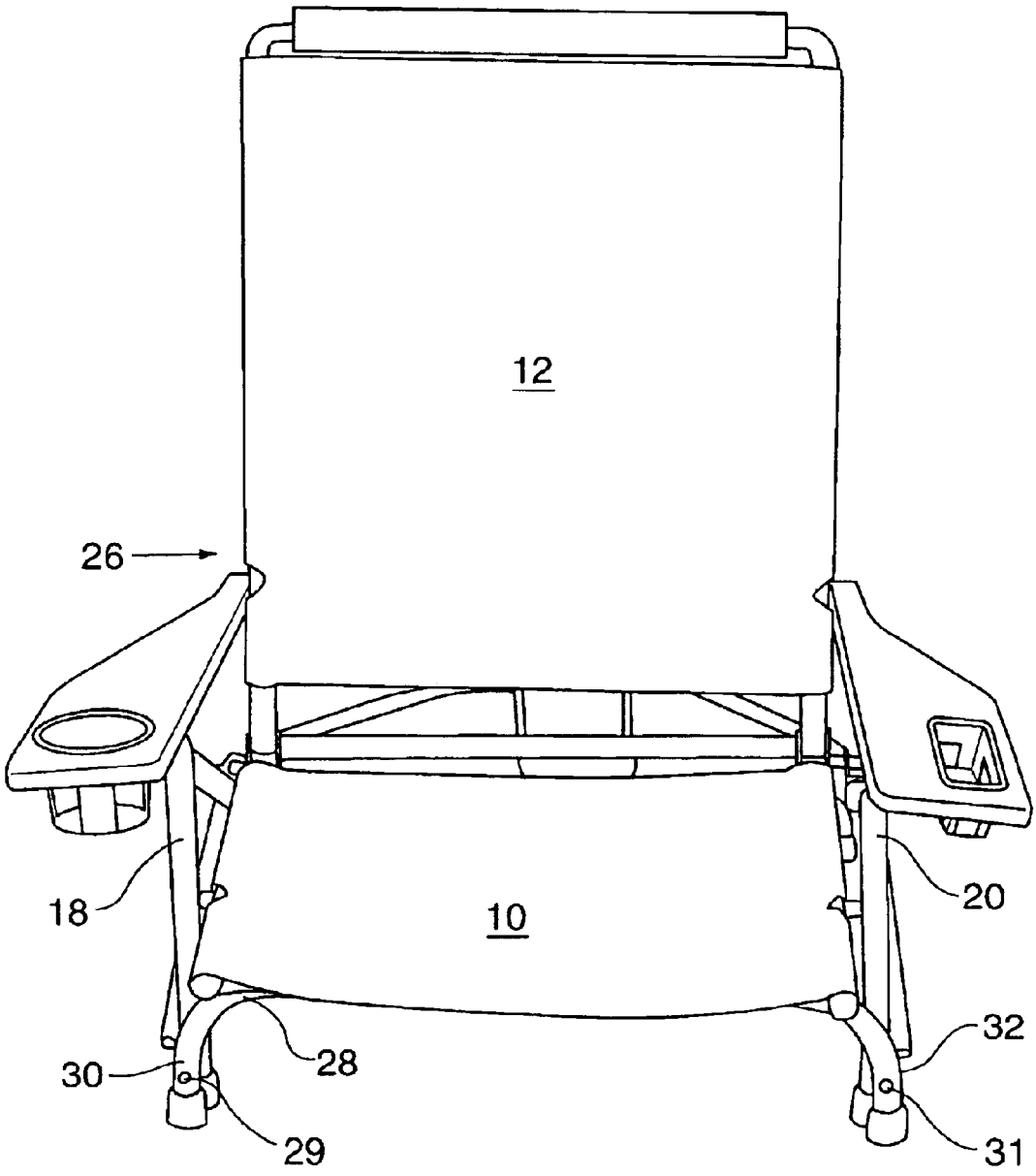
Figure 4:
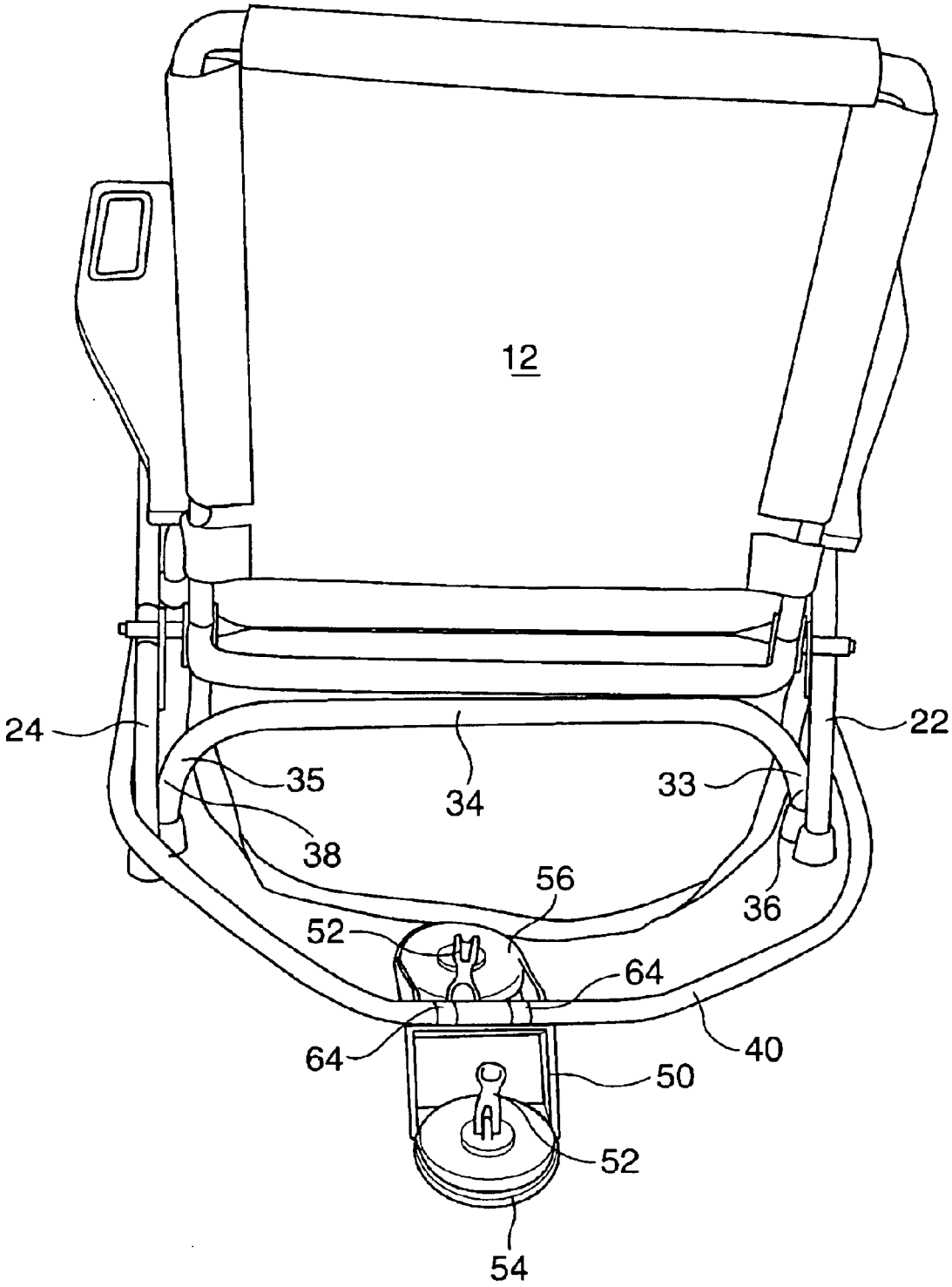
Figure 5:
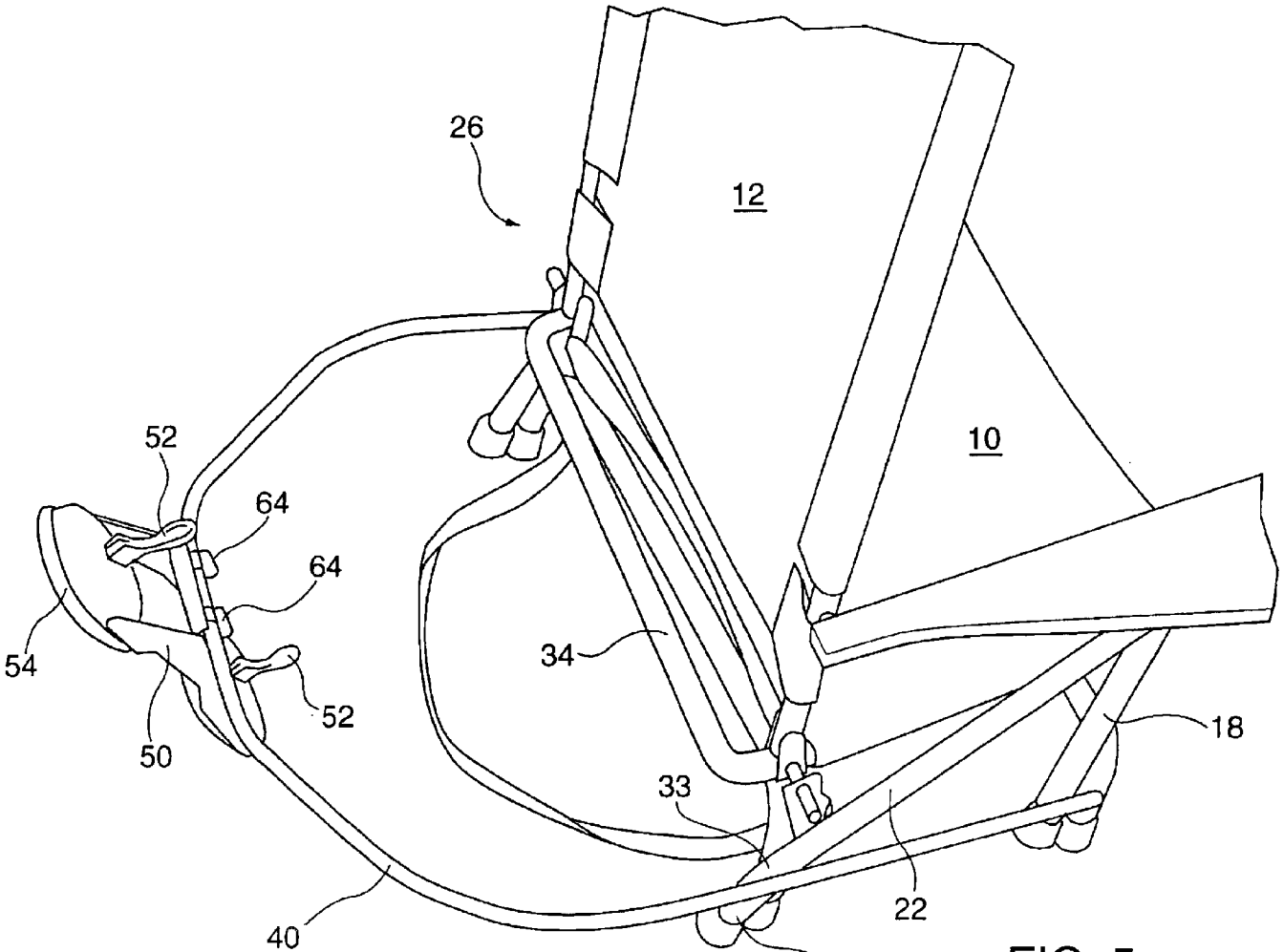

In the Drawings, a collapsible chair of typical construction with a fabric seat 10, a fabric back 12 and arm rests 14, 16 is of tubular construction having a pair of front legs 18, 20 and a pair of rear legs 22, 24 which support the seat 10 when opened as part of a tubular frame 26. A first stabilizer bar 28 is positioned forwardly of the front legs 18, 20 under the seat 10 for support when the chair is opened. The stabilizer bar 28 is secured inwardly of its opposite ends 30, 32—as at 29, 31—to individual ones of the front legs 18, 20 in any appropriate manner, as by rivet, nut-and-bolt, etc. The opposite ends of the stabilizer bar 28 will be appreciated to rest on the same level surface as does the front legs.

A second stabilizer bar 34 is included., positioned forwardly of the rear legs 22, 24 and also under the seat 10 for support when the chair is opened. In manner similar to the first stabilizing bar 28, the second stabilizing bar 34 is secured inwardly—as at 33, 35—of its opposite ends 36, 38 to individual ones of the pair of rear legs 22, 24. Such opposite ends of the stabilizing bar 34 similarly will be understood to rest on the same level surface as do the rear legs. The securement of the second stabilizer bar 34 to the rear legs 22, 24 may also be by way of rivet, nut-and-bolt, etc.

A substantially U-shaped bar 40 extends rearwardly from the front leg 18 to run outwardly along one end of stabilizing bar 34, both rear legs 22, 24 and the opposite end of stabilizer bar 34 to the front leg 20, being held at the two front legs by a cotter pin or other securement which allows the bar 40 to angulate and rotate upwards with respect to the level surface on which the legs rest.

Figure 6A:
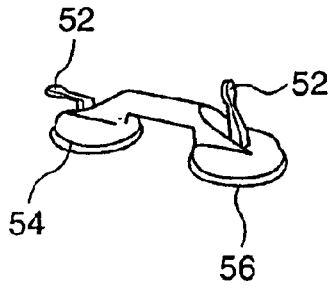
FIGS. 6A, 6B and 6C are helpful in an understanding of the manually operated suction hand cup securement device.
Figure 6B:
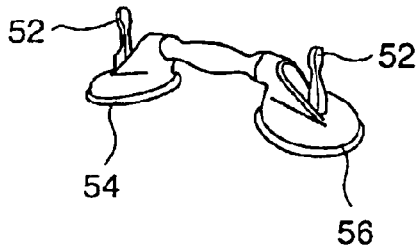
Figure 6C:
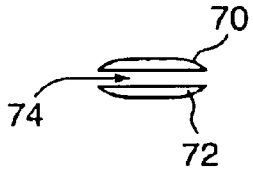

FIGS. 1–5 also illustrate a manually operated suction hand cup 50 coupled with the substantially U-shaped bar 40. Such hand cup operates by flipping cam levers 52 upwardly and downwardly to alternatively release and secure a pair of round suction cups 54, 56 to a flat surface by vacuum action. Although manually operated suction cups of one, three or four of these releasable clamps may be employed, testing has shown that the "double clamp" of this construction is preferable. With the arrangement shown in FIGS. 1–5, the two suction cups 54, 56 lie in a common rigid plane, as shown in FIG. 6A. In accordance with the invention, however, such round-suction cups could equally lie in planes flexible with respect to one another, in offering alternative manners of securement depending upon the construction of the powerboat at whose front the suction cups are to be adhered. Flexible suction cups in this respect may be as illustrated in FIG. 6B. To minimize marring of the powerboat's fiberglass surface, the suction cups 54, 56—whether they be rigid or flexible—are selected of a white rubber construction where available. These manually operated vacuum cup arrangements include hinged top and bottom sections (70, 72 in FIG. 6C) which form a channel 74 to receive the substantially U-shaped bar when passed therebetween, with clamp(s) being provided as at 64 to tightly join the sections 70, 72 in enclosing the bar 40 once in place. Similarly, to minimize marring, the bottom ends of both front legs 1B, 20 and both rear legs 22, 24 are cushioned, also preferably of a white rubber construction, as are the opposite ends of the stabilizer bars 28, 34.

As will be readily appreciated by those skilled in the art, the manually operated suction hand cup 50 fastenly secures the U-shaped bar 40 (and thus the collapsible chair) in position to the level surface, as shown in FIGS. 1–4. Where insufficient flat surface exists on the boat's front deck, the suction hand cup 50 could be rotated as in FIG. 5, so as to bear against the craft's bulkhead or other vertical appendage in securing the chair to be then sat upon. In those powerboat constructions where even less room is available to seat the chair entirely at the bow area, the U-shaped bar 40 along with its manually operated suction hand cup 50 could be rotated so as to allow placement of the suction cups against the windshield of the vessel, with fine tuning of the securement being by way of the additional angulation of the suction cups themselves. As will be appreciated, then, even though the front of the powerboat would bounce while being propelled up and down over the waves, the "Remora" chair remains in secure position, protecting its occupant from being thrown about, especially when also wearing a seat belt if need be. Removing the chair after use will be seen to follow just by flipping open the levers 52 (or "freeing" the pump action) to break the vacuum and release the U-shaped bar 40, so that the chair can then be stored away once more.

Figure 7:
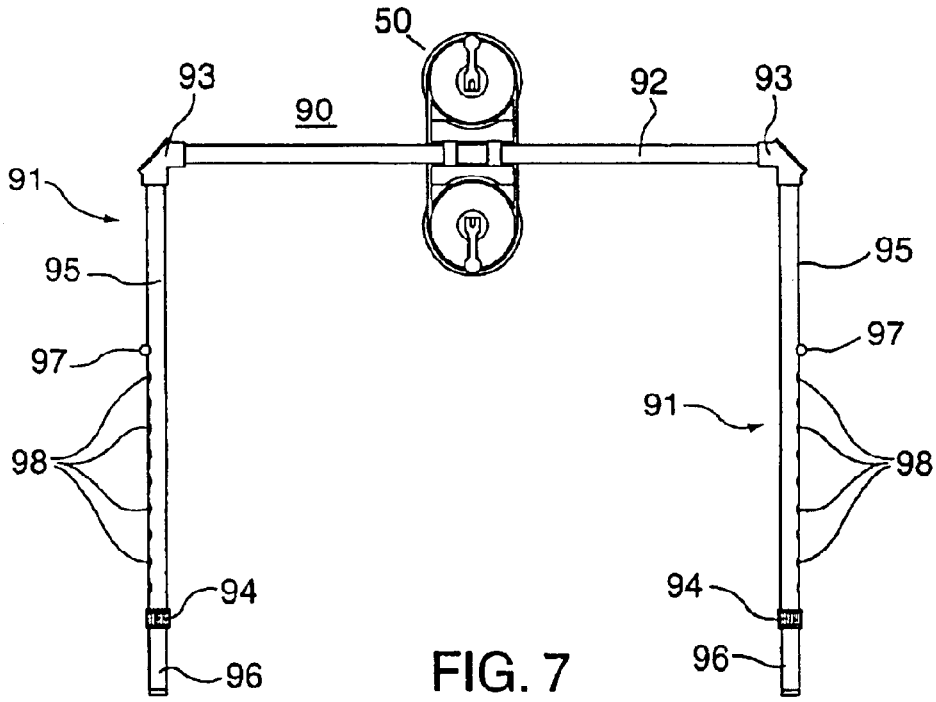
FIG. 7 illustrates an alternative U-shaped bar according to the invention, for that of FIGS. 1–5.

FIG. 7 illustrates an adjustable U-shaped bar 90 which may be substituted for the "static" bar 40 of FIGS. 1–5. A pair of push-button operative, telescoping bars 91 couple with a horizontal bar 92 by means of a 90° conduit pipe 93—with the adjustment in length being accomplished in well known manner by releasing the collar 94 to free the nested lengths 95, 96 to slide together. When lengthened the desired amount, the push-button 97 fits within its capturing aperture 98, and the collar 94 is rotated tight. This feature, together with the horizontal bar 92 being of greater length to receive the suction hand cup 50, facilitates the ease with which the chair is securable to a flat surface of the boat.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the invention.

I claim:

1. For use in a sports fisherman, cruiser and sport powerboat, a combination comprising:

a collapsible chair having pairs of front and rear legs respectively supporting a seat to be sat upon when opened;

a first stabilizer bar positioned forwardly of said front legs and under said seat when said chair is opened, said first stabilizer bar being secured inwardly of opposite ends thereof to individual ones of said pair of front legs, and with said opposite ends of said first stabilizer bar resting on a same level surface as said pair of front legs;

a second stabilizer bar positioned forwardly of said rear legs and under said seat when said chair is opened, said second stabilizer bar being secured inwardly of opposite ends thereof to individual ones of said pair of rear legs, and with said opposite ends of said second stabilizer bar resting on a same level surface as said pair of rear legs;

a substantially U-shaped bar extending rearwardly from one of said pair of front legs running outwardly along one end of said second stabilizer bar, both of said pair of rear legs, and the other end of said second stabilizer bar to the other of said pair of front legs; and a manually operated suction hand cup coupled with said substantially U-shaped bar for releasably securing said collapsible chair to a flat surface by vacuum action.

2. The combination of claim 1 wherein said substantially U-shaped bar extends outwardly of said rear legs and said second stabilizing bar to allow upward angulation thereof with respect to said level surface upon which said pairs of legs and opposite ends of said stabilizer bars rest when said chair is opened.

3. The combination of claim 2 wherein said manually operated suction hand cup includes a pair of oppositely positioned, round suction cups.

4. The combination of claim 2 wherein said manually operated suction hand cup includes a pair of oppositely positioned, round suction cups of white rubber construction.

5. The combination of claim 2 wherein said manually operated suction hand cup includes hinged top and bottom sections forming a channel for receiving said substantially U-shaped bar passing therebetween.

6. The combination of claim 5 including means for clamping together said top and bottom sections to enclose said substantially U-shaped bar in place.

7. The combination of claim 3 wherein said pair of oppositely positioned round suction cups lie in a common, rigid plane.

8. The combination of claim 3 wherein said pair of oppositely positioned, round suction cups lie in planes flexible with respect to one another.

9. The combination of claim 1 wherein said seat is part of a tubular frame supported by said first and second stabilizer bars when said chair is opened.

10. The combination of claim 9 wherein said front and rear legs, said stabilizing bars and said substantially U-shaped bar are constructed of tubular aluminum.

11. The combination of claim 10 wherein said seat is of a fabric construction.

12. The combination of claim 11 wherein bottoms of said front and rear legs and of said first and second stabilizer bars are cushioned.

13. The combination of claim 11 wherein bottoms of said front and rear legs and of said first and second stabilizer bars are of a white rubber construction.

14. The combination of claim 1 wherein said substantially U-shaped bar is adjustable rearwardly in length.

15. The combination of claim 14 wherein said substantially U-shaped bar includes first and second pairs of rearwardly telescoping nesting legs.

* * * * *